United States Patent [19]

VanRens

[11] Patent Number: 4,609,028

[45] Date of Patent: Sep. 2, 1986

[54] EVAPORATIVE PATTERN ASSEMBLY FOR USE IN SAND CASTING

[75] Inventor: Russell J. VanRens, West Allis, Wis.

[73] Assignee: Outboard Marine Corporation, Waukegan, Ill.

[21] Appl. No.: 622,718

[22] Filed: Jun. 20, 1984

[51] Int. Cl.[4] ..... B22C 7/02

[52] U.S. Cl. ..... 164/34; 164/45; 164/246; 164/366

[58] Field of Search ..... 164/411, 34–36, 164/45, 246, 235, 137, 366

[56] References Cited

U.S. PATENT DOCUMENTS

| | | | |
|---|---|---|---|
| 3,041,689 | 7/1962 | Peras | 164/35 |
| 3,868,986 | 3/1975 | Olsen | 164/246 X |
| 3,942,583 | 3/1976 | Peras | 164/246 |
| 4,396,054 | 8/1983 | Cole | 164/34 |

FOREIGN PATENT DOCUMENTS

| | | | |
|---|---|---|---|
| 55-117542 | 9/1980 | Japan | 164/34 |

*Primary Examiner*—Nicholas P. Godici
*Assistant Examiner*—C. McKee
*Attorney, Agent, or Firm*—Michael, Best & Friedrich

[57] ABSTRACT

An evaporative pattern assembly for use in sand casting and comprising a pattern fabricated from evaporative material and including portions forming a cavity, and a member for preventing distortion of the pattern during aging and during sand compaction around the pattern and in the cavity. The distortion preventing member is fabricated from nonevaporative material, extends between the portions of the pattern, and only partially fills the cavity so that sand can flow around the distortion preventing member.

7 Claims, 3 Drawing Figures

EVAPORATIVE PATTERN ASSEMBLY FOR USE IN SAND CASTING

RELATED APPLICATION

Reference is made to co-pending U.S. VanRens patent application Ser. No. 575,144, filed on Jan. 30, 1984, entitled "Process and Apparatus for Lost Foam Casting with Bonded Sand Core".

BACKGROUND OF THE INVENTION

This invention relates to evaporative pattern assemblies and, more particularly, to evaporative pattern assemblies for preventing distortion of a pattern during aging or sand compaction around and in the pattern.

Evaporative pattern assemblies for use in sand casting have previously been provided with bonded sand cores that completely filled cavities disposed in locations where sand would not flow during sand compaction in and around the pattern. The invention disclosed herein is provided for a different purpose and only partially fills the cavity so that sand can flow into the cavity.

Distortion of foam evaporative patterns have customarily been controlled by molding the patterns with foam pieces that were provided solely for reinforcement. When such assemblies were used to produce a casting, metal would remain in the place of the reinforcement foam pieces. Such cast reinforcements increase the weight of the casting and the amount of metal used, and must be removed in instances where the cast metal reinforcements cannot be left in the casting. This invention alleviates the problems caused by such reinforcement foam pieces.

Attention is directed to the following U.S. patents relating to pattern casting:

| Patentee | U.S. Pat. No. | Issued |
|---|---|---|
| Cole | 4,396,054 | August 2, 1983 |
| Peras | 3,041,689 | July 3, 1962 |

SUMMARY OF THE INVENTION

This invention provides an evaporative pattern assembly for use in sand casting. The evaporative pattern assembly comprises a pattern fabricated from evaporative material and including portions forming a cavity, and means for preventing distortion of the pattern during aging and during sand compaction around the pattern and in the cavity. The distortion preventing means is fabricated from nonevaporative material and extends between the portions of the pattern and only partially fills the cavity so that sand can flow around the distortion preventing means.

In one embodiment, the pattern is made of evaporative foam and the distortion preventing means is secured to the portions of the pattern and the distortion preventing means comprises an elongated member fabricated from wood.

One of the principal features of the invention is the provision of an evaporative pattern assembly which will not distort during aging of the pattern, or which will not distort when sand is compacted around the pattern and in a cavity in the pattern.

Another of the principal features of the invention is the provision of such an evaporative pattern assembly which permits, after fabrication of the casting, easy disassembly of means provided for preventing distortion of the pattern.

Other features and advantages of the invention will become apparent to those skilled in the art on review of the following drawings, detailed description and appended claims.

Figure 1:
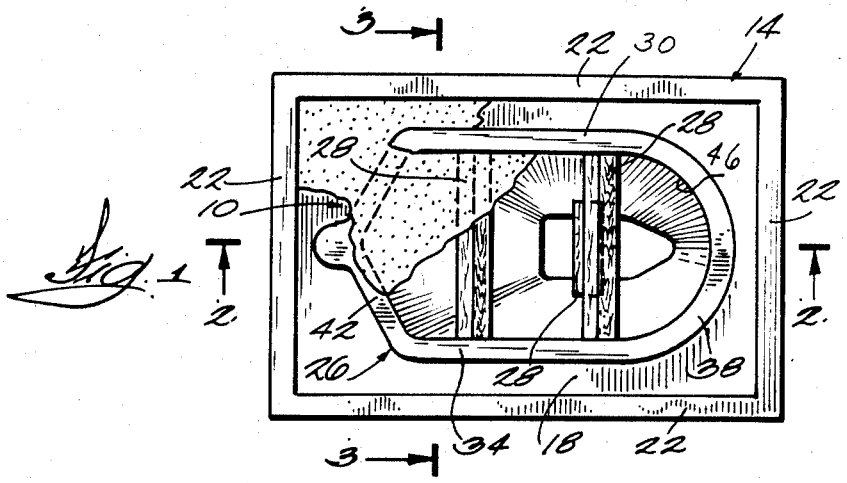
FIG. 1 is a top view of a flask containing an evaporative pattern assembly which embodies various of the features of the invention.
Figure 2:
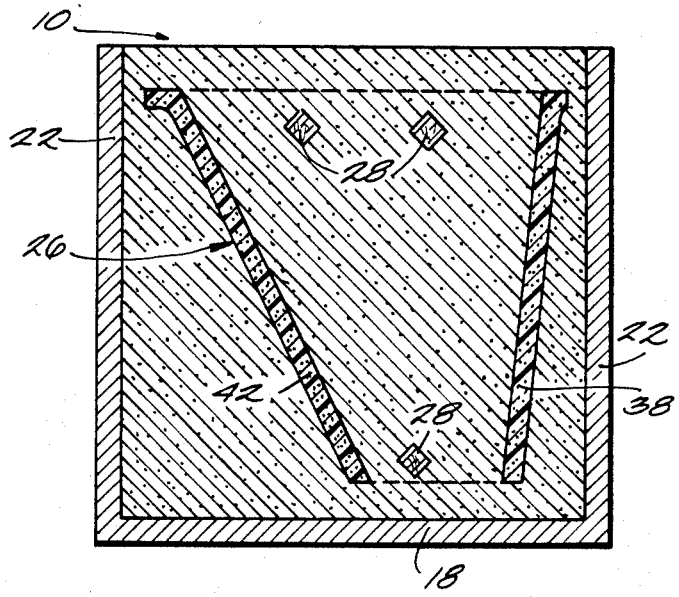
FIG. 2 is a cross-sectional view of the flask and evaporative pattern assembly shown in FIG. 1 taken along the line 2—2 in FIG. 1.
Figure 3:
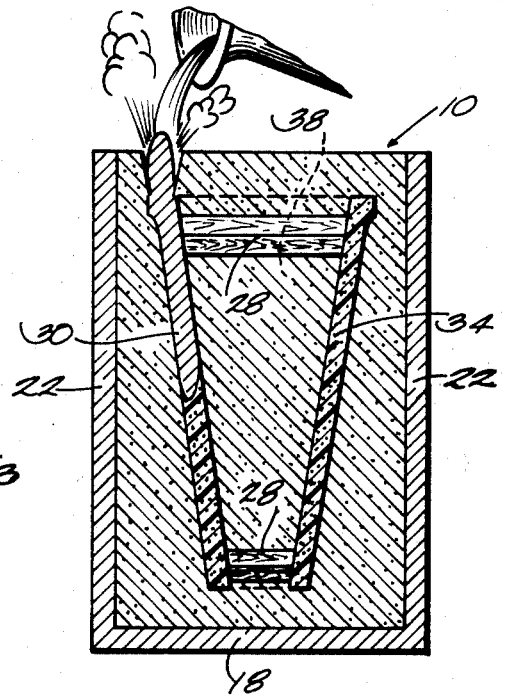
FIG. 3 is a cross-sectional view of the flask and evaporative pattern assembly taken along the line 3—3 in FIG. 1, as liquid metal is added to evaporate the pattern.

Before explaining one embodiment of the invention in detail, it is to be understood that the invention is not limited in its application to the details of construction and the arrangement of components set forth in the following description or illustrated in the drawings. The invention is capable of other embodiments and of being practiced or carried out in various ways. Also it is to be understood that the phraseology and terminology used herein is for the purposes of description and should not be regarded as limited.

DESCRIPTION OF THE PREFERRED EMBODIMENT

Illustrated in the drawings is an evaporative pattern assembly 10 located in a flask 14. Although various constructions can be used, in the preferred embodiment, the flask 14 is shown as having a generally rectangular base 18 and four vertical walls 22.

The evaporative pattern assembly 10 comprises a pattern 26 fabricated from evaporative material and means 28 for preventing distortion of the pattern 26 during aging and during sand compaction in and around the pattern 26.

The pattern 26 shown is molded of evaporative foam, is generally hollow, and includes two spaced-apart side walls 30 and 34, respectively, which are tapered inwardly toward the bottom of the pattern 26. The pattern 26 also includes a generally vertical curved rear wall 38 and a front V-shaped wall 42 inclined inwardly toward the bottom of the pattern 26. The four walls 30, 34, 38 and 42 of the pattern 26 thus form a cavity 46 in the interior of the pattern 26. In other embodiments (not shown), other pattern shapes including portions forming one or more cavities can be used.

Located between the pattern walls 30 and 34 is the means 28 for preventing distortion of the pattern 26 during aging and during sand compaction around the pattern 26 and in the cavity 40. In this embodiment, the distortion preventing means 28 is in the form of a plurality of elongated members fabricated from wood. In other embodiments, other nonevaporative materials, such as cardboard, paper, and bonded core sand can be used. Each of the distortion preventing members 28 extends between opposed portions of the walls 30 and 34 of the pattern 26 and only partially fills the cavity 46 so that sand can flow around the distortion preventing members 28. In the illustrated embodiment, the distortion preventing members 28 are held in place by means of an adhesive. In other embodiments, the distortion preventing members 28 can be molded, pressed, frictionally secured or otherwise held in place. Each of the elongated members 28 can be readily cut to fit between different portions of the foam pattern 26.

Three locations are shown where, for the pattern 26 illustrated, distortion preventing members 28 are positioned. Other locations could alternately or additionally be used to prevent distortion of the pattern 26. In addition to extending perpendicularly between opposed flat portions of the pattern 26, as illustrated in this embodiment, distortion preventing members 28 can also extend at an angle from portions of the pattern or between two curved portions or between a curved and a flat portion. In addition, other distortion preventing members with various shapes and sizes can also be used.

After sand is compacted in and around the evaporative pattern assembly 10, hot metal is poured into the foam pattern 26. The hot metal evaporates the foam, and then cools and solidifies without destroying the members 28. Subsequently, the distortion preventing members 28 can be easily removed from the casting when the sand in and around the casting is removed from the flask 14.

Various of the other features of the invention are set forth in the following claims.

I claim:

1. An evaporative pattern assembly for use in sand casting and comprising a pattern fabricated from evaporative material and including spaced wall portions forming a cavity, and means for preventing distortion of said pattern, said means being fabricated from nonevaporative material and extending exteriorly of said evaporative material and across said cavity and between said wall portions of said pattern and only partially filling said cavity so that sand can flow around and about said distortion preventing means so as to otherwise fill said cavity with sand.

2. An evaporative pattern assembly in accordance with claim 1 wherein said distortion preventing means is secured to said portions of said pattern.

3. An evaporative pattern assembly in accordance with claim 1 wherein said distortion preventing means comprises an elongated member fabricated from wood and wherein said pattern is made of evaporative foam.

4. An evaporated pattern assembly in accordance with claim 1 wherein said distortion preventing means extends perpendicularly to said portions of said pattern.

5. An evaporative pattern assembly in accordance with claim 1 wherein said means for preventing distortion of said pattern occupies only a minor portion of said cavity.

6. An evaporative pattern assembly for use in sand casting and comprising a foam pattern including spaced wall portions forming a cavity, and means for preventing distortion of said pattern during aging and during sand compaction around said pattern and in said cavity, said means comprising an elongated member fabricated from wood and extending across said cavity and between said wall portions and being secured to said wall portions of said pattern and only partially filling said cavity so that sand can flow around and about said elongated member so as to otherwise fill said cavity.

7. An evaporated pattern assembly in accordance with claim 5 wherein said elongated member extends perpendicularly to said portions of said pattern.

* * * * *